US009647315B2

(12) United States Patent
Yamatogi et al.

(10) Patent No.: US 9,647,315 B2
(45) Date of Patent: May 9, 2017

(54) DIRECTIONAL COUPLER

(71) Applicant: Murata Manufacturing Co., Ltd., Kyoto (JP)

(72) Inventors: Shinya Yamatogi, Kyoto (JP); Nobuyoshi Okuda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/683,192

(22) Filed: Apr. 10, 2015

(65) Prior Publication Data

US 2015/0311577 A1 Oct. 29, 2015

(30) Foreign Application Priority Data

Apr. 28, 2014 (JP) ..... 2014-092792

(51) Int. Cl.
*H01P 5/18* (2006.01)
*H01P 3/08* (2006.01)

(52) U.S. Cl.
CPC ..... *H01P 5/187* (2013.01)

(58) Field of Classification Search
CPC ..... H01P 5/18; H01P 5/187
USPC ..... 333/109–113, 116
See application file for complete search history.

(56) References Cited

U.S. PATENT DOCUMENTS 3,764,941 A 10/1973 Nick
3,999,150 A * 12/1976 Caragliano ..... H01P 5/185 333/116
5,369,379 A * 11/1994 Fujiki ..... H01P 5/185 333/116
6,208,220 B1 * 3/2001 Logothetis ..... H01P 5/185 333/116
6,515,556 B1 * 2/2003 Kato ..... H01P 5/185 333/116
6,771,141 B2 * 8/2004 Iida ..... H01P 5/185 333/109
7,567,147 B2 * 7/2009 Toujo ..... H01P 5/185 333/116

(Continued)

FOREIGN PATENT DOCUMENTS

JP H09-153708 A 6/1997
JP WO 2012096047 A1 * 7/2012 ..... H01P 5/187
JP 2012-186734 A 9/2012

OTHER PUBLICATIONS

Notice of Reasons for Rejection issued in Japanese Patent Application No. 2014-092792 dated Mar. 22, 2016.

*Primary Examiner* — Dean Takaoka
(74) *Attorney, Agent, or Firm* — Pearne & Gordon, LLP

(57) ABSTRACT

A directional coupler includes a multilayer structure formed by stacking a plurality of dielectric layers including first and second dielectric layers; a main line including first and second main line portions that are electrically connected in series to each other; and a sub line electromagnetically coupled with the main line, the sub line including first and second sub line portions that are electrically connected in series to each other. The first main line portion and the first sub line portion are provided on the first dielectric layer. The second main line portion and the second sub line portion are provided on the second dielectric layer. In planar view along a stacking direction, the first main line portion and the second sub line portion overlap one another, and the first sub line portion and the second main line portion overlap one another.

14 Claims, 10 Drawing Sheets

(56) References Cited

U.S. PATENT DOCUMENTS 9,035,718 B2 * 5/2015 Tamaru ..... H01P 5/187
333/109

* cited by examiner

DIRECTIONAL COUPLER

BACKGROUND OF THE INVENTION

1. Field of the Invention

The present disclosure relates to directional couplers, and, in particular, a directional coupler including a main line and a sub line.

2. Description of the Related Art

For example, as one of directional couplers in related art, a directional coupler disclosed in Japanese Unexamined Patent Application Publication No. 9-153708 (hereinafter, patent document 1) is known. This directional coupler includes a plurality of dielectric layers, a first coupling line, a second coupling line, a first ground electrode, and a second ground electrode.

The plurality of dielectric layers has a substantially rectangular shape, and the layers included therein are stacked on top of each other in an up-and-down direction. The first coupling line and the second coupling line are provided on the dielectric layers that are different from each other, and electromagnetically couple to each other. The first coupling line is located above the second coupling line. The first ground electrode is provided on a dielectric layer located above the first coupling line. The second ground electrode is provided on a dielectric layer located below the second coupling line. The directional coupler configured as described above achieves downsizing and low insertion loss, and has a sufficient isolation characteristic.

However, in the directional coupler described in the patent document 1, it is possible to have a difference between the characteristic impedance of the first coupling line and the characteristic impedance of the second coupling line. Specifically, in the directional coupler, there may be manufacturing variation in thickness in the plurality of dielectric layers. Therefore, there may be variation between the distance from the first coupling line to the first ground electrode and the distance from the second coupling line to the second ground electrode. This may cause a deviation from a preset capacitance to be formed between the first coupling line and the first ground electrode and a deviation from a preset capacitance to be formed between the second coupling line and the second ground electrode, and there may be variation between the amount of the former deviation and the amount of the latter deviation. As a result, a difference is likely to occur between the characteristic impedance of the first coupling line and the characteristic impedance of the second coupling line.

SUMMARY OF THE INVENTION

Accordingly, the present disclosure provides a directional coupler that may suppress the occurrence of a difference between the characteristic impedance of a main line and the characteristic impedance of a sub line.

A directional coupler according to a preferred embodiment of the present disclosure includes: a multilayer structure formed by stacking a plurality of dielectric layers, the plurality of dielectric layers including a first dielectric layer and a second dielectric layer; a main line including a first main line portion and a second main line portion, the first main line portion and the second main line portion being electrically connected in series to each other; and a sub line that is electromagnetically coupled with the main line, the sub line including a first sub line portion and a second sub line portion, the first sub line portion and the second sub line portion being electrically connected in series to each other;

wherein the first main line portion and the first sub line portion are provided on the first dielectric layer, the second main line portion and the second sub line portion are provided on the second dielectric layer, and, in planar view along a stacking direction, the first main line portion and the second sub line portion overlap one another, and the first sub line portion and the second main line portion overlap one another.

According to preferred embodiments of the present disclosure, the occurrence of a difference between the characteristic impedance of the main line and the characteristic impedance of the sub line may be suppressed.

Other features, elements, characteristics and advantages of the present disclosure will become more apparent from the following detailed description of preferred embodiments of the present disclosure with reference to the attached drawings.

DESCRIPTION OF THE PREFERRED EMBODIMENTS

Figure 1:
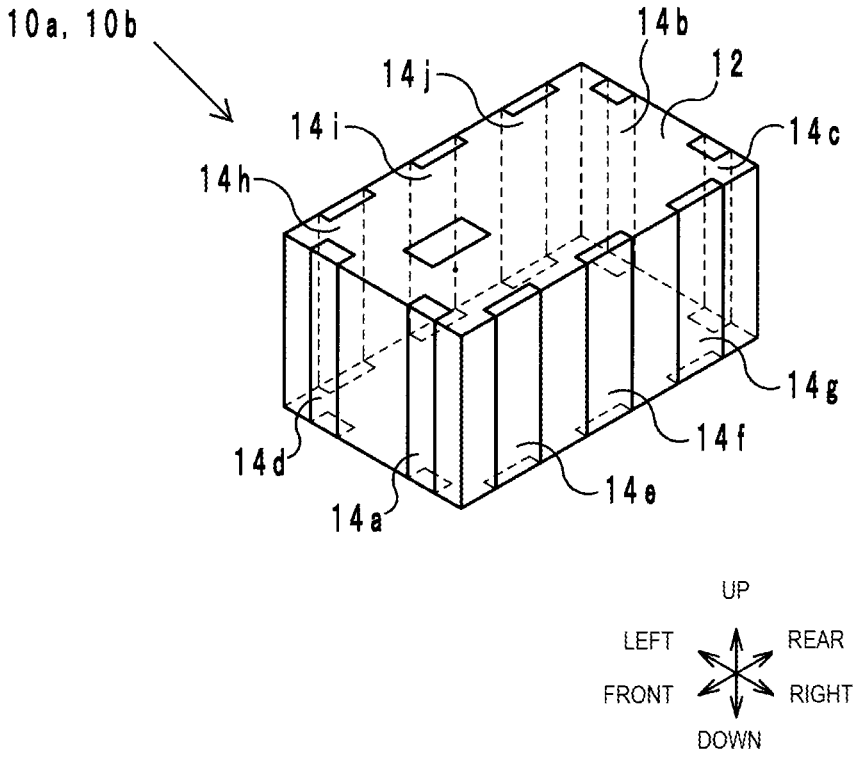
FIG. 1 is an external perspective view of directional couplers.
Figure 2:
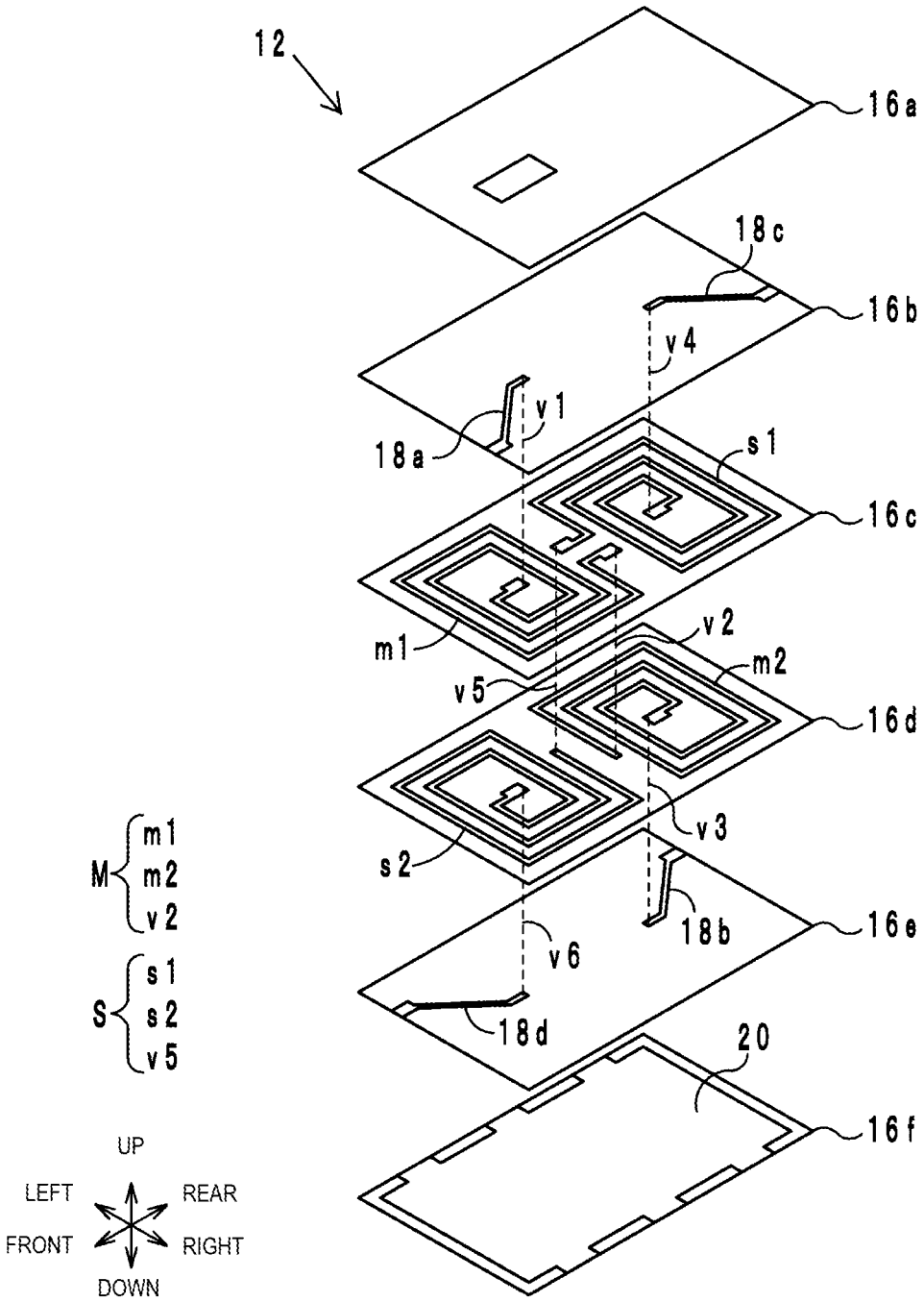
FIG. 2 is an exploded perspective view of a multilayer structure of a directional coupler.

A directional coupler according to an embodiment of the present disclosure will be described below with reference to drawings. FIG. 1 is an external perspective view of directional couplers 10*a* and 10*b*. FIG. 2 is an exploded perspective view of a multilayer structure 12 of the directional coupler 10*a*. In the following description, a stacking direction is defined as an up-and-down direction (e.g., a direction perpendicular to a topside principle surface of the multilayer structure 12), a longer-side direction of the directional coupler 10*a* in planar view from topside is defined as a front-and-rear direction, and a shorter-side direction of the directional coupler 10*a* in planar view from topside is defined as a right-and-left direction.

The directional coupler 10*a* includes, as illustrated in FIG. 1 and FIG. 2, the multilayer structure 12, outer electrodes 14*a* to 14*j*, a main line M, a sub line S, lead conductors 18*a* to 18*d*, a ground conductor 20, via-hole conductors v1, v3, v4, and v6.

As illustrated in FIG. 2, the multilayer structure 12 is substantially cuboid in form and is configured in such a way that substantially rectangle dielectric layers 16*a* to 16*f*, which are substantially made of dielectric ceramic, are stacked in this order from top to bottom. In the following description, the topside principle surface of the multilayer structure 12 is referred to as a top plane, and a bottom-side principle surface of the multilayer structure 12 is referred to as a bottom plane. An end surface at the front side of the multilayer structure 12 is referred to as a front plane, and an end surface at the rear side of the multilayer structure 12 is referred to as a rear plane. A side surface at the right side of the multilayer structure 12 is referred to as a right plane, and a side surface at the left side of the multilayer structure 12 is referred to as a left plane. The bottom plane of the multilayer structure 12 is a mounting plane that faces a circuit board when the directional coupler 10*a* is mounted on the circuit board. Topside surfaces of the dielectric layers 16*a* to 16*f* are referred to as top surfaces, and bottom-side surfaces of the dielectric layers 16*a* to 16*f* are referred to as back surfaces.

The outer electrodes 14*e*, 14*f*, and 14*g* are arranged so as to line up in this order on the right plane of the multilayer structure 12 from the front side to the rear side. The outer electrodes 14*e*, 14*f*, and 14*g* are extended in the up-and-down direction and folded at the top plane and the bottom plane.

The outer electrodes 14*h*, 14*i*, and 14*j* are arranged so as to line up in this order on the left plane of the multilayer structure 12 from the front side to the rear side. The outer electrodes 14*h*, 14*i*, and 14*j* are extended in the up-and-down direction and folded at the top plane and the bottom plane.

The outer electrodes 14*a* and 14*d* are arranged so as to line up in this order on the front plane of the multilayer structure 12 from the right side to the left side. The outer electrodes 14*a* and 14*d* are extended in the up-and-down direction and folded at the top plane and the bottom plane.

The outer electrodes 14*c* and 14*b* are arranged so as to line up in this order on the rear plane of the multilayer structure 12 from the right side to the left side. The outer electrodes 14*c* and 14*b* are extended in the up-and-down direction and folded at the top plane and the bottom plane.

The outer electrodes 14*a* to 14*j* are formed by applying Ni plating or Sn plating to underlayer electrodes that have been formed by coating surfaces of the multilayer structure 12 with an electrically conductive paste whose primary component is Ag.

The main line M is provided inside the multilayer structure 12, and includes main line portions m1, m2, and a via-hole conductor v2. For example, the characteristic impedance of the main line M is about 50Ω. The main line portion m1 is a substantially line-shaped conductor provided at a front half of the top surface of the dielectric layer 16*c*. In planar view from topside, the main line portion m1 forms a substantially spiral shape that makes a plurality of clockwise turns from an end portion at an outer circumference side, which is located on the right side of a center (intersection of diagonal lines) of the dielectric layer 16*c*, to an end portion at an inner circumference side, which is located at a substantially center of the front half of the dielectric layer 16*c*. In the following description, the end portion at the inner circumference side of the main line portion m1 is referred to as an inner circumference end, and the end portion at the outer circumference side of the main line portion m1 is referred to as an outer circumference end.

The main line portion m2 is a substantially line-shaped conductor provided at a rear half of the top surface of the dielectric layer 16*d* that is provided below the dielectric layer 16*c*. In planar view from topside, the main line portion m2 forms a substantially spiral shape that makes a plurality of clockwise turns from an end portion at an outer circumference side, which is located on the right side of a center (intersection of diagonal lines) of the dielectric layer 16*d*, to an end portion at an inner circumference side, which is located at a substantially center of the rear half of the dielectric layer 16*d*. In the following description, the end portion at the inner circumference side of the main line portion m2 is referred to as an inner circumference end, and the end portion at the outer circumference side of the main line portion m2 is referred to as an outer circumference end.

For example, the main line portions m1 and m2 are formed by coating the dielectric layers 16*c* and 16*d* with an electrically conductive paste whose primary component is a metal composed of Cu or Ag.

The via-hole conductor v2 penetrates the dielectric layer 16*c* in the up-and-down direction and electrically connects the outer circumference end of the main line portion m1 and the outer circumference end of the main line portion m2. This allows the main line portion m1 and the main line portion m2 to be electrically connected in series via the via-hole conductor v2.

The lead conductor 18*a* is a substantially straight line-shaped conductor provided at the top surface of the dielectric layer 16*b* that is provided above the dielectric layer 16*c*. In planar view from topside, one end portion of the lead conductor 18*a* overlaps the inner circumference end of the main line portion m1. The lead conductor 18*a* extends toward a front-right direction from the one end portion. The other end portion of the lead conductor 18*a* is extracted to the front shorter side of the dielectric layer 16*b* and electrically connected to the outer electrode 14*a*.

The via-hole conductor v1 penetrates the dielectric layer 16*b* in the up-and-down direction and electrically connects the one end portion of the lead conductor 18*a* and the inner circumference end of the main line portion m1. This allows the via-hole conductor v1 and the lead conductor 18*a* to electrically connect the inner circumference end of the main line portion m1 and the outer electrode 14*a*.

The lead conductor 18*b* is a substantially straight line-shaped conductor provided at the top surface of the dielectric layer 16*e* that is provided below the dielectric layer 16*d*. In planar view from topside, one end portion of the lead conductor 18*b* overlaps the inner circumference end of the main line portion m2. The lead conductor 18*b* extends toward a rear-left direction from the one end portion. The other end portion of the lead conductor 18*b* is extracted to the rear shorter side of the dielectric layer 16*e* and electrically connected to the outer electrode 14*b*.

For example, the lead conductors 18*a* and 18*b* are formed by coating the dielectric layers 16*b* and 16*e* with an electrically conductive paste whose primary component is a metal composed of Cu or Ag.

The via-hole conductor v3 penetrates the dielectric layer 16*d* in the up-and-down direction and electrically connects the one end portion of the lead conductor 18*b* and the inner circumference end of the main line portion m2. This allows the via-hole conductor v3 and the lead conductor 18*b* to electrically connect the inner circumference end of the main line portion m2 and the outer electrode 14*b*.

The via-hole conductors v1 to v3 are formed by filing through-holes formed in the dielectric layers 16*b* to 16*d* with an electrically conductive paste whose primary component is a metal composed of Cu or Ag.

The sub line S is provided inside the multilayer structure 12 and electromagnetically coupled to the main line M. The sub line S includes sub line portions s1, s2 and a via-hole conductor v5. For example, the characteristic impedance of the sub line S is about 50Ω. The sub line portion s1 is a substantially line-shaped conductor provided at a rear half of the top surface of the dielectric layer 16*c*. In planar view from topside, the sub line portion s1 forms a substantially spiral shape that makes a plurality of clockwise turns from an end portion at an outer circumference side, which is located on the left side of a center (intersection of diagonal lines) of the dielectric layer 16*c*, to an end portion at an inner circumference side, which is located at a substantially center of the rear half of the dielectric layer 16*c*. In the following description, the end portion at the inner circumference side of the sub line portion s1 is referred to as an inner circumference end, and the end portion at the outer circumference side of the sub line portion s1 is referred to as an outer circumference end.

Here, in planar view from topside, the main line portion m2 and the sub line portion s1 overlap one another. Further, in planar view from topside, the main line portion m2 and the sub line portion s1 run side by side for substantially the whole length. Specifically, the main line portion m2 and the sub line portion s1 overlap one another so as to coincide with each other in planar view from topside except portions near their outer circumference ends.

In planar view from topside, the main line portion m1 and the sub line portion s1 are point-symmetric with respect to the intersection of diagonal lines of the dielectric layers 16*c*. Thus, the main line portion m1 matches the sub line portion s1 when the main line portion m1 is rotated about the intersection of diagonal lines of the dielectric layer 16*c* by about 180 degrees.

The sub line portion s2 is a substantially line-shaped conductor provided at a front half of the top surface of the dielectric layer 16*d* that is provided below the dielectric layer 16*c*. In planar view from topside, the sub line portion s2 forms a substantially spiral shape that makes a plurality of clockwise turns from an end portion at an outer circumference side, which is located on the left side of a center (intersection of diagonal lines) of the dielectric layer 16*d*, to an end portion at an inner circumference side, which is located at a substantially center of the front half of the dielectric layer 16*d*. Line widths of the main line portions m1 and m2 are substantially equal to line widths of the sub line portions s1 and s2. In the following description, the end portion at the inner circumference side of the sub line portion s2 is referred to as an inner circumference end, and the end portion at the outer circumference side of the sub line portion s2 is referred to as an outer circumference end.

Here, in planar view from topside, the main line portion m1 and the sub line portion s2 overlap one another. Further, in planar view from topside, the main line portion m1 and the sub line portion s2 run side by side for substantially the whole length. Specifically, the main line portion m1 and the sub line portion s2 overlap one another so as to coincide with each other in planar view from topside except portions near their outer circumference ends.

In planar view from topside, the main line portion m2 and the sub line portion s2 are point-symmetric with respect to the intersection of diagonal lines of the dielectric layers 16*d*. Thus, the main line portion m2 matches the sub line portion s2 when the main line portion m2 is rotated about the intersection of diagonal lines of the dielectric layer 16*d* by about 180 degrees.

For example, the sub line portions s1 and s2 are formed by coating the dielectric layers 16*c* and 16*d* with an electrically conductive paste whose primary component is a metal composed of Cu or Ag.

The via-hole conductor v5 penetrates the dielectric layer 16*c* in the up-and-down direction and electrically connects the outer circumference end of the sub line portion s1 and the outer circumference end of the sub line portion s2. This allows the sub line portion s1 and the sub line portion s2 to be electrically connected in series via the via-hole conductor v5.

The lead conductor 18*c* is a substantially straight line-shaped conductor provided at the top surface of the dielectric layer 16*b* that is provided above the dielectric layer 16*c*. In planar view from topside, one end portion of the lead conductor 18*c* overlaps the inner circumference end of the sub line portion s1. The lead conductor 18*c* extends toward a rear-right direction from the one end portion. The other end portion of the lead conductor 18*c* is extracted to the rear shorter side of the dielectric layer 16*b* and electrically connected to the outer electrode 14*c*.

Here, in planar view from topside, the lead conductor 18*b* and the lead conductor 18*c* form two sides of a substantially isosceles triangle, which are substantially equal in length.

The via-hole conductor v4 penetrates the dielectric layer 16*b* in the up-and-down direction and electrically connects one end portion of the lead conductor 18*c* and the inner circumference end of the sub line portion s1. This allows the via-hole conductor v4 and the lead conductor 18*c* to electrically connect the inner circumference end of the sub line portion s1 and the outer electrode 14*c*.

The lead conductor 18*d* is a substantially straight line-shaped conductor provided at the top surface of the dielectric layer 16*e* that is provided below the dielectric layer 16*d*. In planar view from topside, one end portion of the lead conductor 18*d* overlaps the inner circumference end of the sub line portion s2. The lead conductor 18*d* extends toward a front-left direction from the one end portion. The other end portion of the lead conductor 18*d* is extracted to the front shorter side of the dielectric layer 16*e* and electrically connected to the outer electrode 14*d*.

For example, the lead conductors 18*c* and 18*d* are formed by coating the dielectric layers 16*b* and 16*e* with an electrically conductive paste whose primary component is a metal composed of Cu or Ag.

Here, in planar view from topside, the lead conductor 18*a* and the lead conductor 18*d* form two sides of a substantially isosceles triangle, which are substantially equal in length. In planar view from topside, the lead conductor 18*a* and the lead conductor 18*b* are point-symmetric with respect to the intersection of diagonal lines of the dielectric layers 16*b*. In planar view from topside, the lead conductor 18*c* and the lead conductor 18*d* are point-symmetric with respect to the intersection of diagonal lines of the dielectric layer 16*b*. Line widths of the lead conductors 18*a* to 18*d* are substantially equal to each other.

The via-hole conductor v6 penetrates the dielectric layer 16*d* in the up-and-down direction and electrically connects one end portion of the lead conductor 18*d* and the inner circumference end of the sub line portion s2. This allows the via-hole conductor v6 and the lead conductor 18*d* to electrically connect the inner circumference end of the sub line portion s2 and the outer electrode 14*d*.

The ground conductor 20 is a substantially rectangular conductor provided at the top surface of the dielectric layer 16*f* that is provided below the dielectric layer 16*d*. In planar view from topside, the ground conductor 20 overlaps the main line portions m1, m2, the sub line portions s1, and s2. The ground conductor 20 is electrically connected to, via three protruded portions extending to the right from the right longer side, the outer electrodes 14*e* to 14*g*. The ground conductor 20 is electrically connected to, via three protruded portions extending to the left from the left longer side, the outer electrodes 14*h* to 14*j*.

For example, the ground conductor 20 is formed by coating the dielectric layer 16*f* with an electrically conductive paste whose primary component is a metal composed of Cu or Ag.

In the foregoing directional coupler 10*a*, the outer electrode 14*a* is used as an input port, and the outer electrode 14*b* is used as an output port. The outer electrode 14*d* is used as a coupling port, and the outer electrode 14*c* is used as a terminator port for terminating at about 50Ω. The outer electrodes 14*e* to 14*j* are used as ground ports to be grounded. When a signal is inputted to the outer electrode 14*a*, the signal is outputted from the outer electrode 14*b*. Further, since the main line M and the sub line S are electromagnetically coupled to each other, a signal having a power proportional to the power of the signal outputted from the outer electrode 14*b* is outputted from the outer electrode 14*d*.

Advantageous Effects

According to the directional coupler 10*a* configured as above, the occurrence of a difference between the characteristic impedance of the main line M and the characteristic impedance of the sub line S may be suppressed. Specifically, the main line portion m1 and the sub line portion s1 are provided on the dielectric layer 16*c*. Therefore, the distance from the main line portion m1 to the ground conductor 20 may be kept substantially the same as the distance from the sub line portion s1 to the ground conductor 20 even when there is variation in the thicknesses of the dielectric layers 16*a* to 16*f*. Thus, it is unlikely to have any difference between the capacitance formed between the main line portion m1 and the ground conductor 20 and the capacitance formed between the sub line portion s1 and the ground conductor 20.

The main line portion m2 and the sub line portion s2 are provided on the dielectric layer 16*d*. Therefore, the distance from the main line portion m2 to the ground conductor 20 may be kept substantially the same as the distance from the sub line portion s2 to the ground conductor 20 even when there is variation in the thicknesses of the dielectric layers 16*a* to 16*f*. Thus, it is unlikely to have any difference between the capacitance formed between the main line portion m2 and the ground conductor 20 and the capacitance formed between the sub line portion s2 and the ground conductor 20.

As described above, even when there is variation in the thicknesses of the dielectric layers 16*a* to 16*f*, it is unlikely to have any difference between the capacitance formed between the main line M and the ground conductor 20 and the capacitance formed between the sub line S and the ground conductor 20. In other words, it is unlikely to have any difference between the characteristic impedance of the main line M and the characteristic impedance of the sub line S.

Further, according to the directional coupler 10*a*, the height in the up-and-down direction may be suppressed (hereinafter, profile height lowering). Specifically, in the directional coupler described in the patent document 1, the first ground electrode is provided on the dielectric layer located above the first coupling line. The second ground electrode is provided on the dielectric layer located below the second coupling line. In other words, two ground electrodes are provided. This is to make two capacitances closer to each other, one of the two capacitances being formed between the first coupling line and the first ground electrode and between the first coupling line and the second ground electrode, and the other being formed between the second coupling line and the first ground electrode and between the second coupling line and the second ground electrode.

However, the directional coupler described in the patent document 1 uses the two ground electrodes, and thus is liable to be higher in the stacking direction. On the other hand, if one of the ground electrodes is absent, it is likely to have a difference between the capacitance formed between the first coupling line and the ground electrode and the capacitance between the second coupling line and the ground electrode.

In view of this, the directional coupler 10*a* is provided with the main line portion m1 and the sub line portion s1 on the dielectric layer 16*c*. This makes the distance from the main line portion m1 to the ground conductor 20 substantially equal to the distance from the sub line portion s1 to the ground conductor 20. Accordingly, it is unlikely to have any difference between the capacitance formed between the main line portion m1 and the ground conductor 20 and the capacitance formed between the sub line portion s1 and the ground conductor 20. Further, the main line portion m2 and the sub line portion s2 are provided on the dielectric layer 16*d*. This makes the distance from the main line portion m2 to the ground conductor 20 substantially equal to the distance from the sub line portion s2 to the ground conductor 20. Accordingly, it is unlikely to have any difference between the capacitance formed between the main line portion m2 and the ground conductor 20 and the capacitance formed between the sub line portion s2 and the ground conductor 20.

As described above, the directional coupler 10*a* allows the capacitance formed between the main line M and the ground conductor 20 and the capacitance formed between the sub line S and the ground conductor 20 to be closer to each other by including only one ground conductor 20. As a result, the profile height lowering at the directional coupler 10*a* may be achieved. It should be noted that this does not preclude the provision of a ground conductor at a location above the main line portion m1 and the sub line portion s1 so as to overlap the main line portion m1 and the sub line portion s1.

Further, in the directional coupler 10*a*, downsizing may be achieved. For example, in order to configure a 3-dB directional coupler from the directional coupler described in the patent document 1, it is preferable that the lengths of the first coupling line and the second coupling line are about a quarter of the wavelength of a high frequency signal to be transmitted via the first coupling line and the second coupling line. To achieve downsizing in such a 3-dB directional coupler, it is conceivable to increase the dielectric constant of dielectric layers. This reduces the wavelength of a high frequency signal to be transmitted via the first coupling line and the second coupling line, thereby reducing the lengths of the first coupling line and the second coupling line shorter.

However, as the dielectric constant of dielectric layers increases, the capacitances formed between the first and the second coupling lines and the first and the second ground electrodes increase. As a result, the characteristic impedances of the first coupling line and the second coupling line decrease and deviate from the preset characteristic impedances (for example, about 50Ω).

Thus, in the directional coupler 10*a*, as described in the above, no ground conductor is provided above the main line M and the sub line S. Accordingly, the characteristic impedances of the main line M and the sub line S become larger since the capacitances formed at the main line M and the sub line S are smaller in the directional coupler 10*a* compared to the directional coupler described in the patent document 1. As a result, in the directional coupler 10*a*, the downsizing may be achieved while suppressing the decline of the characteristic impedances of the main line M and the sub line S.

Further, the directional coupler 10*a* facilitates designing of the main line M and the sub line S. Specifically, if the first ground electrode were removed from the directional coupler described in the patent document 1, the first coupling line and the second coupling line each form a capacitor with the second ground electrode. However, the distance from the first coupling line to the second ground electrode is different from the distance the second coupling line to the second ground electrode. Thus, the designing of the first coupling line and the second coupling line needs to be performed in consideration of how to make the capacitance formed between the first coupling line and the second ground electrode and the capacitance formed between the second coupling line and the second ground electrode closer to each other.

On the other hand, in the directional coupler 10*a*, the main line portion m1 and the sub line portion s1 are provided on the dielectric layer 16*c*. Further, the main line portion m2 and the sub line portion s2 are provided on the dielectric layer 16*d*. This makes the distance from the main line portion m1 to the ground conductor 20 substantially equal to the distance from the sub line portion s1 to the ground conductor 20. Similarly, this also makes the distance from the main line portion m2 to the ground conductor 20 substantially equal to the distance from the sub line portion s2 to the ground conductor 20. In other words, in the directional coupler 10*a*, the distance from the main line M to the ground conductor 20 may be made substantially equal to the distance from the sub line S to the ground conductor 20 even when only one ground conductor 20 is provided. Therefore, it is desirable to make the structures of the main line portion m1 and sub line portion s1 closer to each other and make the structures of the main line portion m2 and sub line portion s2 closer to each other in order to make the capacitance formed between the main line M and the ground conductor 20 and the capacitance formed between the sub line S and the ground conductor 20 closer to each other. As a result, in the directional coupler 10*a*, the designing of the main line M and the sub line S may be easily performed.

Further, the directional coupler 10*a* allows the characteristic impedance of the lead conductor 18*a* and the characteristic impedance of the lead conductor 18*c* to be closer to each other. Specifically, the lead conductor 18*a* and the lead conductor 18*c* are provided on the same top surface of the dielectric layer 16*b*. This makes the distance from the lead conductor 18*a* to the ground conductor 20 substantially equal to the distance from the lead conductor 18*c* to the ground conductor 20. In other words, the capacitance formed between the lead conductor 18*a* and the ground conductor 20 and the capacitance formed between the lead conductor 18*c* and the ground conductor 20 may be made closer to each other. Accordingly, the characteristic impedance of the lead conductor 18*a* and the characteristic impedance of the lead conductor 18*c* may be made closer to each other. For the same reason, the characteristic impedance of the lead conductor 18*b* and the characteristic impedance of the lead conductor 18*d* may be made closer to each other.

Further, in the directional coupler 10*a*, the lead conductor 18*a* is inclined with respect to the front shorter side of the dielectric layer 16*b*. This enables the adjustment of the characteristic impedance of the lead conductor 18*a* by adjusting a crossing condition between the lead conductor 18*a* and the main line M by means of adjusting an angle formed between the lead conductor 18*a* and the front short side of the dielectric layer 16*b*. For the same reason, the characteristic impedances of the lead conductors 18*b* to 18*c* may also be adjusted.

Further, according to the directional coupler 10*a*, the occurrence of a difference between the characteristic impedance of the main line M and the characteristic impedance of the sub line S may be suppressed. Specifically, in planar view from topside, the lead conductor 18*a* and the lead conductor 18*d* form two sides of a substantially isosceles triangle, which are substantially equal in length. Further, in planar view from topside, the lead conductor 18*b* and the lead conductor 18*c* form two sides of a substantially isosceles triangle, which are substantially equal in length. This makes the shapes of the main line M, the lead conductors 18*a*, and 18*b* and the shapes of the sub line S, the lead conductors 18*c*, and 18*d* point-symmetric. As a result, the occurrence of a difference between the characteristic impedance of the main line M and the characteristic impedance of the sub line S may be suppressed.

In the directional coupler 10*a*, the main line portions m1 and m2 make clockwise turns from the outer circumference side to the inner circumference side. Further, the outer circumference end of the main line portion m1 is electrically connected to the outer circumference end of the main line portion m2. For example, when a current flows in the main line M toward the outer electrode 14*b* from the outer electrode 14*a*, an anti-clockwise current flows in the main line portion m1, and an upward magnetic field is produced at a substantially center of the main line portion m1. Further, a clockwise current flows in the main line portion m2, and a downward magnetic field is produced at a substantially center of the main line portion m2. In other words, the direction of the magnetic field produced at a substantially center of the main line portion m1 is opposite to the direction of the magnetic field produced at a substantially center of the main line portion m2. In this case, these magnetic fields couple to each other at a location above the main line portions m1 and m2 as well as a location below the main line portions m1 and m2. This facilitates the forming of stronger magnetic field coupling between the main line portion m1 and the main line portion m2. For the same reason, this facilitates the forming of stronger magnetic field coupling between the sub line portion s1 and the sub line portion s2.

Further, in the directional coupler 10*a*, the main line portion m1 and the sub line portion s2 make clockwise turns from the outer circumference side to the inner circumference side and run side by side in planar view from topside. This facilitates the forming of stronger magnetic field coupling between the main line portion m1 and the sub line portion s2. For the same reason, this facilitates the forming of stronger magnetic field coupling between the main line portion m2 and the sub line portion s1.

Modified Embodiment

Figure 3:
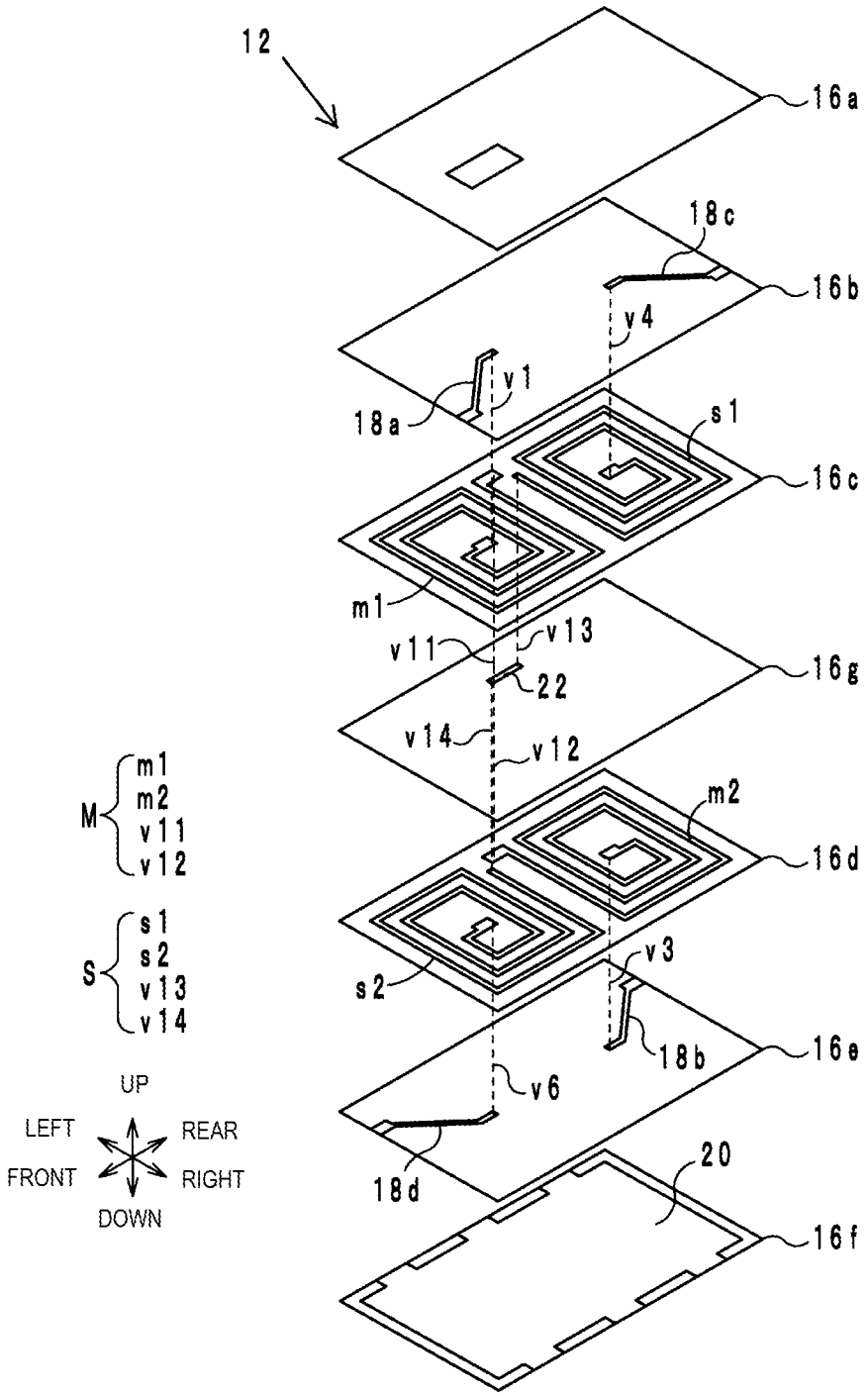
FIG. 3 is an exploded perspective view of a multilayer structure of another directional coupler.

A directional coupler according to a modified embodiment will be described below with reference to drawings. FIG. 3 is an exploded perspective view of a multilayer structure 12 of a directional coupler 10*b*. Here, FIG. 1 is used as an external perspective view of the directional coupler 10*b*.

The directional coupler 10*b* differs from the directional coupler 10*a* in the following two aspects:

First Difference: Number of dielectric layers stacked in the multilayer structure 12

Second Difference: Shapes of main line M and sub line S

The first difference is now described. The multilayer structure 12 of the directional coupler 10*b* is formed by stacking dielectric layers 16*a* to 16*c*, 16*g*, and 16*d* to 16*f* in this order from top to bottom. In other words, in the multilayer structure 12 of the directional coupler 10*b*, the dielectric layer 16*g* is inserted between the dielectric layer 16*c* and the dielectric layer 16*d*.

The second difference is now described. The main line M includes main line portions m1, m2, via-hole conductors v11, and v12. The main line portion m1 is a substantially line-shaped conductor provided at a front half of the top surface of the dielectric layer 16*c*. In planar view from topside, the main line portion m1 forms a substantially spiral shape that makes a plurality of clockwise turns from an end portion at an outer circumference side, which is located on the left side of a center (intersection of diagonal lines) of the dielectric layer 16*c*, to an end portion at an inner circumference side, which is located at a substantially center of the front half of the dielectric layer 16*c*. In the following description, the end portion at the inner circumference side of the main line portion m1 is referred to as an inner circumference end, and the end portion at the outer circumference side of the main line portion m1 is referred to as an outer circumference end.

The main line portion m2 is a substantially line-shaped conductor provided at a rear half of the top surface of the dielectric layer 16*d* that is provided below the dielectric layer 16*c*. In planar view from topside, the main line portion m2 forms a substantially spiral shape that makes a plurality of anti-clockwise turns from an end portion at an outer circumference side, which is located on the left side of a center (intersection of diagonal lines) of the dielectric layer 16*d*, to an end portion at an inner circumference side, which is located at a substantially center of the rear half of the dielectric layer 16*d*. In other words, the main line portion m2 of the directional coupler 10*b* turns around in a direction opposite to the main line portion m2 of the directional coupler 10*a*. In the following description, the end portion at the inner circumference side of the main line portion m2 is referred to as an inner circumference end, and the end portion at the outer circumference side of the main line portion m2 is referred to as an outer circumference end.

The via-hole conductor v11 penetrates the dielectric layer 16*c* in the up-and-down direction. The via-hole conductor v12 penetrates the dielectric layer 16*g* in the up-and-down direction. The via-hole conductor v11 and the via-hole conductor v12 collectively form a single via-hole conductor by connecting to each other, and electrically connect the outer circumference end of the main line portion m1 and the outer circumference end of the main line portion m2. This allows the main line portion m1 and the main line portion m2 to be electrically connected in series via the via-hole conductors v11 and v12.

Lead conductors 18*a*, 18*b*, via-hole conductors v1, and v3 of the directional coupler 10*b* are substantially the same as the lead conductors 18*a*, 18*b*, the via-hole conductors v1, and v3 of the directional coupler 10*a*, and thus descriptions thereof are omitted.

The sub line S is provided inside the multilayer structure 12, and is electromagnetically coupled with the main line M. The sub line S includes sub line portions s1 and s2, a connection conductor 22, via-hole conductors v13, and v14. The sub line portion s1 is a substantially line-shaped conductor provided at a rear half of the top surface of the dielectric layer 16*c*. In planar view from topside, the sub line portion s1 forms a substantially spiral shape that makes a plurality of anti-clockwise turns from an end portion at an outer circumference side, which is located on the left side of a center (intersection of diagonal lines) of the dielectric layer 16*c*, to an end portion at an inner circumference side, which is located at a substantially center of the rear half of the dielectric layer 16*c*. In other words, the sub line portion s1 of the directional coupler 10*b* turns around in a direction opposite to the sub line portion s1 of the directional coupler 10*a*. In the following description, the end portion at the inner circumference side of the sub line portion s1 is referred to as an inner circumference end, and the end portion at the outer circumference side of the sub line portion s1 is referred to as an outer circumference end.

Here, in planar view from topside, the main line portion m2 and the sub line portion s1 overlap one another. Further, in planar view from topside, the main line portion m2 and the sub line portion s1 run side by side for substantially the whole length. Specifically, the main line portion m2 and the sub line portion s1 overlap one another so as to coincide with each other in planar view from topside except portions near their outer circumference ends.

In planar view from topside, shapes of the main line portion m1 and the sub line portion s1 are line-symmetric with respect to a straight line that extends in the right-and-left direction and passes through the intersection of diagonal lines of the dielectric layer 16*c*.

The sub line portion s2 is a substantially line-shaped conductor provided at a front half of the top surface of the dielectric layer 16*d* that is provided below the dielectric layer 16*c*. In planar view from topside, the sub line portion s2 forms a substantially spiral shape that makes a plurality of clockwise turns from an end portion at an outer circumference side, which is located on the left side of a center (intersection of diagonal lines) of the dielectric layer 16*d*, to an end portion at an inner circumference side, which is located at a substantially center of the front half of the dielectric layer 16*d*. In the following description, the end portion at the inner circumference side of the sub line portion s2 is referred to as an inner circumference end, and the end portion at the outer circumference side of the sub line portion s2 is referred to as an outer circumference end.

The connection conductor 22 is a substantially straight line-shaped conductor that is provided on the top surface of the dielectric layer 16*g* and extended in the front-and-rear direction. In planar view from topside, a front end of the connection conductor 22 overlaps the outer circumference end of the sub line portion s2. In planar view from topside, a rear end of the connection conductor 22 overlaps the outer circumference end of the sub line portion s1.

Here, in planar view from topside, the main line portion m1 and the sub line portion s2 overlap one another. Further, in planar view from topside, the main line portion m1 and the sub line portion s2 run side by side for substantially the whole length. Specifically, the main line portion m1 and the sub line portion s2 overlap one another so as to coincide with each other in planar view from topside except portions near their outer circumference ends.

In planar view from topside, shapes of the main line portion m2 and the sub line portion s2 are line-symmetric with respect to a straight line that extends in the right-and-left direction and passes through the intersection of diagonal lines of the dielectric layer 16*d*.

The via-hole conductor v13 penetrates the dielectric layer 16*c* in the up-and-down direction and electrically connects the outer circumference end of the sub line portion s1 and the rear end of the connection conductor 22. The via-hole conductor v14 penetrates the dielectric layer 16*g* in the up-and-down direction and electrically connects the outer circumference end of the sub line portion s2 and the front end of the connection conductor 22. This allows the sub line portion s1 and the sub line portion s2 to be electrically connected in series via the via-hole conductors v13, v14, and the connection conductor 22.

Lead conductors 18*c*, 18*d*, via-hole conductors v4, and v6 of the directional coupler 10*b* are substantially the same as the lead conductors 18*c*, 18*d*, the via-hole conductors v4, and v6 of the directional coupler 10*a*, and thus descriptions thereof are omitted. Further, a ground conductor 20 of the directional coupler 10*b* is also substantially the same as the ground conductor 20 of the directional coupler 10*a*, and thus a description thereof is omitted.

In the foregoing directional coupler 10*b*, an outer electrode 14*a* is used as an input port, and an outer electrode 14*b* is used as an output port. An outer electrode 14*d* is used as a coupling port, and an outer electrode 14*c* is used as a terminator port for terminating at about 50Ω. The outer electrodes 14*e* to 14*j* are used as ground ports to be grounded. When a signal is inputted to the outer electrode 14*a*, the signal is outputted from the outer electrode 14*b*. Further, since the main line M and the sub line S are electromagnetically coupled to each other, a signal having a power proportional to the power of the signal outputted from the outer electrode 14*b* is outputted from the outer electrode 14*d*.

Advantageous Effects

The directional coupler 10*b* configured as described above has substantially the same functions and effects as the directional coupler 10*a*.

In the directional coupler 10*b*, the main line portion m1 makes clockwise turns from the outer circumference side to the inner circumference side. The main line portion m2 makes anti-clockwise turns from the outer circumference side to the inner circumference side. Further, the outer circumference end of the main line portion m1 is electrically connected to the outer circumference end of the main line portion m2. For example, when a current flows in the main line M toward the outer electrode 14*b* from the outer electrode 14*a*, an anti-clockwise current flows in the main line portion m1, and an upward magnetic field is produced at a substantially center of the main line portion m1. Further, an anti-clockwise current flows in the main line portion m2, and an upward magnetic field is produced at a substantially center of the main line portion m2. In other words, the direction of the magnetic field produced at a substantially center of the main line portion m1 is the same as the direction of the magnetic field produced at a substantially center of the main line portion m2. In this case, these magnetic fields cancel out each other. As a result, the main line portion m1 and the main line portion m2 form a weaker magnetic field coupling. For the same reason, the sub line portion s1 and the sub line portion s2 form a weaker magnetic field coupling.

According to the foregoing directional couplers 10*a* and 10*b*, the strength of magnetic field coupling between the main line portion m1 and the main line portion m2 and the strength of magnetic field coupling between the sub line portion s1 and the sub line portion s2 may be adjusted by altering the shapes of the main line M and the sub line S. Thus, it is preferable to determine which one of the directional coupler 10*a* and the directional coupler 10*b* is to be used depending on the intended use.

Computer Simulation

Figure 4:
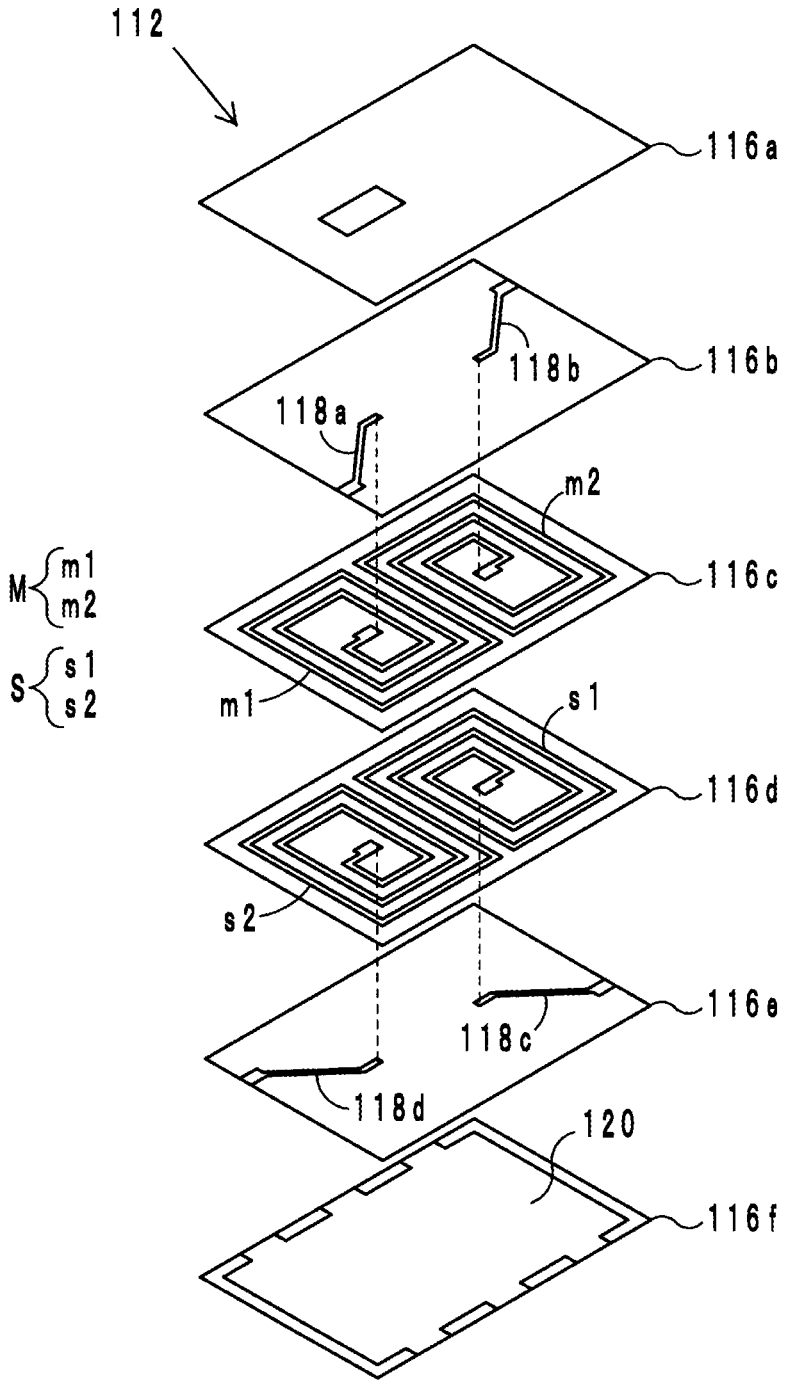
FIG. 4 is an exploded perspective view of a multilayer structure of a directional coupler according to a comparison example.

The inventors of the present application carried out the following computer simulation to further clarify advantageous effects of the directional couplers 10*a* and 10*b*. FIG. 4 is an exploded perspective view of a multilayer structure 112 of a directional coupler 100 according to a comparison example.

The inventors of the present application fabricated a first model having the configuration of the directional coupler 10*a*, a second model having the configuration of the directional coupler 10*b*, and a third model having the configuration of the directional coupler 100. Here, the directional coupler 100 is described.

In the directional coupler 100, reference numerals of elements that correspond to the directional coupler 10*a* are represented by adding 100 to the reference numerals of the corresponding elements of the directional coupler 10*a*. In the following description, the directional coupler 100 is briefly described, focusing on features different from the directional coupler 10*a*.

A main line portion m1 and a main line portion m2 are provided on the same top surface of a dielectric layer 116*c*. The main line portion m1 and the main line portion m2 turn around in opposite directions. Further, an outer circumference end of the main line portion m1 and an outer circumference end of the main line portion m2 are electrically connected to each other. A sub line portion s1 and a sub line portion s2 are provided on the same top surface of a dielectric layer 116*d*. The sub line portion s1 and the sub line portion s2 turn around in opposite directions. Further, an outer circumference end of the sub line portion s1 and an outer circumference end of the sub line portion s2 are electrically connected to each other.

Figure 5A:
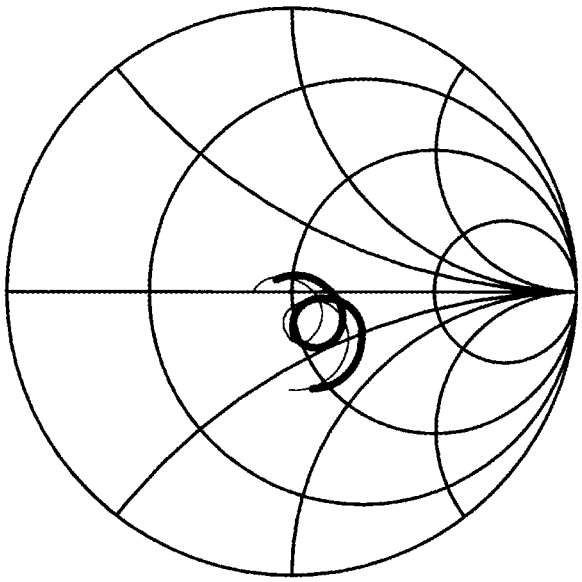
FIG. 5A is Smith chart for a third model.
Figure 5B:
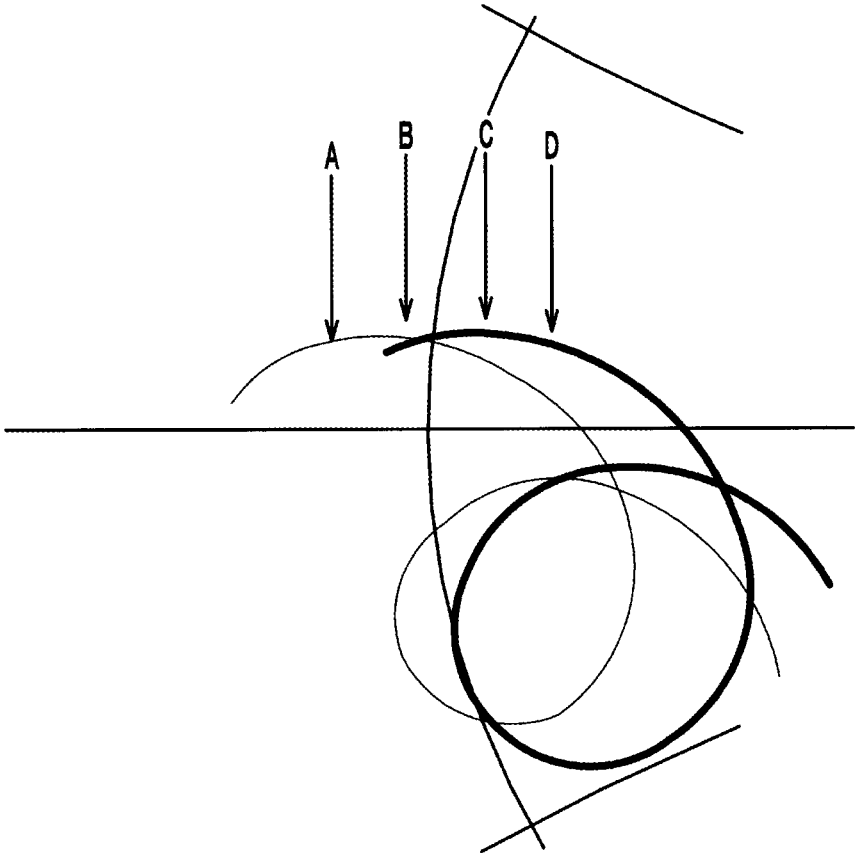
FIG. 5B is an expanded view of FIG. 5A.
Figure 6A:
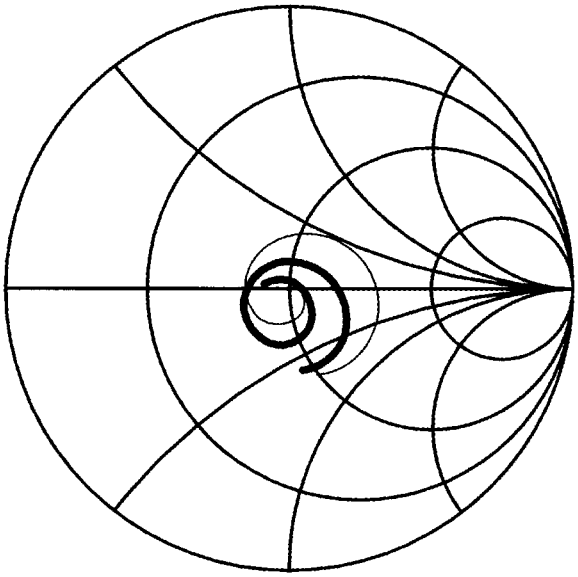
FIG. 6A is Smith chart for a first model.
Figure 6B:
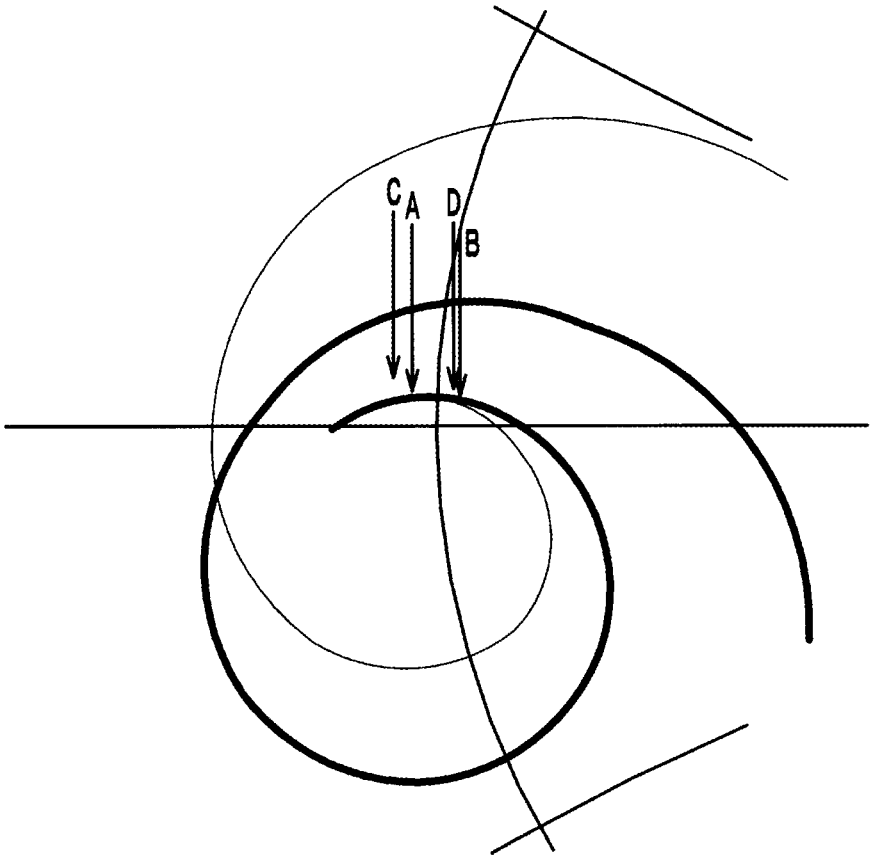
FIG. 6B is an expanded view of FIG. 6A.
Figure 7A:
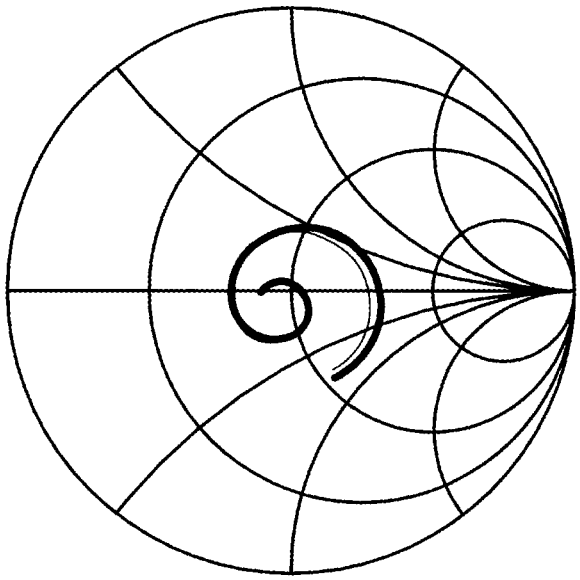
FIG. 7A is Smith chart for a second model.
Figure 7B:
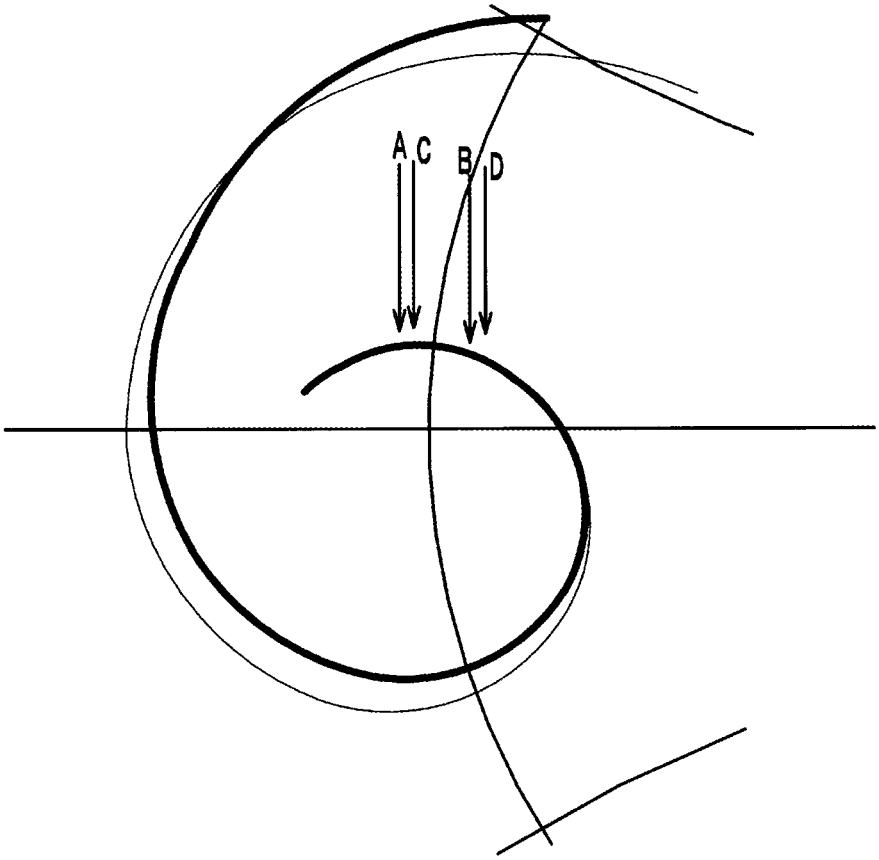
FIG. 7B is an expanded view of FIG. 7A.

The inventors of the present application produced Smith charts for the first model to the third model by inputting high frequency signals of about 0.1 GHz to about 6.0 GHz to the first model, the second model, and the third model, which are fabricated as described above. FIG. 5A is Smith chart for the third model. FIG. 5B is an expanded view of FIG. 5A. FIG. 6A is Smith chart for the first model. FIG. 6B is an expanded view of FIG. 6A. FIG. 7A is Smith chart for the second model. FIG. 7B is an expanded view of FIG. 7A. Fine lines in the drawings indicate the characteristic impedance of the main line M, and bold lines in the drawings indicate the characteristic impedance of the sub line S. Further, arrows A indicate the characteristic impedance of the main line M at about 0.7 GHz, and arrows B indicate the characteristic impedance of the main line M at about 0.8 GHz.

Arrows C indicate the characteristic impedance of the sub line S at about 0.7 GHz, and arrows D indicate the characteristic impedance of the sub line S at about 0.8 GHz.

Referring to FIG. 5A and FIG. 5B, it is clear that the bold line and the fine line are separated from each other. This illustrates that a difference is present between the characteristic impedance of the main line M and the characteristic impedance of the sub line S. In particular, at about 0.7 GHz that is a frequency band to be used at base stations of cellular phones (hereinafter, frequency band in use), the characteristic impedance of the main line M (arrow A (44.712+j4.4247Ω)) and the characteristic impedance of the sub line S (arrow C (53.334+j6.130Ω)) are considerably separated from each other. Similarly, at about 0.8 GHz that is another frequency band in use, the characteristic impedance of the main line M (arrow B (48.541+j5.330Ω)) and the characteristic impedance of the sub line S (arrow D (57.453+j5.627Ω)) are considerably separated from each other.

On the other hand, referring to FIG. 6A and FIG. 6B, it is clear that a portion near the center of the bold line and a portion near the center of the fine line are closer to each other. This illustrates that the difference between the characteristic impedance of the main line M and the characteristic impedance of the sub line S becomes smaller at a relatively lower frequency band. In particular, at about 0.7 GHz that is the frequency band in use, the characteristic impedance of the main line M (arrow A (48.682+j1.797Ω)) and the characteristic impedance of the sub line S (arrow C (47.770+j2.069Ω)) are closer to each other. Similarly, at about 0.8 GHz that is the frequency band in use, the characteristic impedance of the main line M (arrow B (51.408+j1.226Ω)) and the characteristic impedance of the sub line S (arrow D (51.016+j1.844Ω)) are closer to each other. Thus, it is clear that the second model (directional coupler 10*a*) has less difference between the characteristic impedance of the main line M and the characteristic impedance of the sub line S compared to the first model (directional coupler 100).

Referring to FIG. 7A and FIG. 7B, it is clear that the bold line and the fine line are closer to each other for substantially the whole length. This illustrates that, at a frequency band from about 0.1 GHz to about 6.0 GHz, the difference between the characteristic impedance of the main line M and the characteristic impedance of the sub line S are smaller. In particular, at about 0.7 GHz that is the frequency band in use, the characteristic impedance of the main line M (arrow A (47.787+j5.108Ω)) and the characteristic impedance of the sub line S (arrow C (48.269+j5.273Ω)) are closer to each other. Similarly, at about 0.8 GHz that is the frequency band in use, the characteristic impedance of the main line M (arrow B (51.897+j4.786Ω)) and the characteristic impedance of the sub line S (arrow D (52.379+j4.894Ω)) are closer to each other. Thus, it is clear that the third model (directional coupler 10*b*) has less difference between the characteristic impedance of the main line M and the characteristic impedance of the sub line S compared to the first model (directional coupler 100).

Other Embodiments

The directional couplers according to embodiments of present disclosure are not limited to the directional couplers 10*a* and 10*b* according to the foregoing embodiments and may be altered within the scope of the present disclosure.

The constituting elements of the directional couplers 10*a* and 10*b* may be arbitrarily combined.

The directional couplers 10*a* and 10*b* may not be provided with the ground conductor 20. In this case, capacitances are formed between a ground conductor, which is embedded in a circuit substrate to which the directional coupler 10*a* or 10*b* is mounted, and the main line M and the sub line S.

In the directional couplers 10*a* and 10*b*, the ground conductor 20 may be provided above the main line M and the sub line S.

Alternatively, in the directional couplers 10*a* and 10*b*, a ground conductor may be provided above the main line M and the sub line S, and the ground conductor 20 may be provided below the main line M and the sub line S.

In the directional couplers 10*a* and 10*b*, the line widths of the main line portions m1 and m2 are substantially equal to the line widths of the sub line portions s1 and s2. Alternatively, these line widths may be made different from each other. This enables the adjustment of strength of electric field coupling between the main line portion m1 and the sub line portion s2. Similarly, this enables the adjustment of strength of electric field coupling between the main line portion m2 and the sub line portion s1.

The shape of the main line portion m1 and the shape of the sub line portion s2 may differ from each other, and the shape of the main line portion m2 and the shape of the sub line portion s1 may differ from each other.

The present disclosure may be applicable to directional couplers, and in particular, is superior in having the features that enable to suppress the occurrence of a difference between the characteristic impedance of the main line M and the characteristic impedance of the sub line S.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A directional coupler comprising:

a multilayer structure comprising a plurality of dielectric layers being stacked, the plurality of dielectric layers including a first dielectric layer and a second dielectric layer;

a main line including a first main line portion and a second main line portion, the first main line portion and the second main line portion being electrically connected in series to each other; and a sub line that is electromagnetically coupled with the main line along a stacking direction, the sub line including a first sub line portion and a second sub line portion, the first sub line portion and the second sub line portion being electrically connected in series to each other; wherein the first main line portion and the first sub line portion are provided on the first dielectric layer, the second main line portion and the second sub line portion are provided on the second dielectric layer, and in a planar view along the stacking direction, the first main line portion and the second sub line portion overlap one another, and the first sub line portion and the second main line portion overlap one another.

2. The directional coupler according to claim 1, further comprising:

a first ground conductor, wherein the second dielectric layer is provided at a location further toward one side of the stacking direction than the first dielectric layer, the plurality of dielectric layers further includes a third dielectric layer, the third dielectric layer being provided at a location further toward the one side of the stacking direction than the second dielectric layer, and the first ground conductor is provided on the third dielectric layer.

3. The directional coupler according to claim 2, wherein in the planar view along the stacking direction, the first ground conductor overlaps the second main line portion and the second sub line portion.

4. The directional coupler according to claim 2, wherein in the planar view along the stacking direction, the first main line portion, the second main line portion, the first sub line portion, and the second sub line portion are substantially spiral in shape.

5. The directional coupler according to claim 4, wherein in the planar view along the stacking direction, the first main line portion and the second sub line portion turn in a first direction from outer circumference side to inner circumference side and run side by side, and in the planar view along the stacking direction, the first sub line portion and the second main line portion turn in the first direction from outer circumference side to inner circumference side and run side by side.

6. The directional coupler according to claim 5, wherein in the planar view along the stacking direction, the dielectric layer is substantially rectangular in shape, in the planar view along the stacking direction, shapes of the first main line portion and the first sub line portion are point-symmetric, and in the planar view along the stacking direction, shapes of the second main line portion and the second sub line portion are point-symmetric.

7. The directional coupler according to claim 4, wherein in the planar view along the stacking direction, the first main line portion and the second sub line portion turn in a first direction from outer circumference side to inner circumference side and run side by side, and in the planar view along the stacking direction, the first sub line portion and the second main line portion turn in a second direction from outer circumference side to inner circumference side and run side by side, the second direction being opposite to the first direction.

8. The directional coupler according to claim 4, further comprising:

a first outer electrode, a second outer electrode, a third outer electrode, and a fourth outer electrode; and a first lead conductor, a second lead conductor, a third lead conductor, and a fourth lead conductor, wherein an end portion of the first main line portion on the outer circumference side and an end portion of the second main line portion on the outer circumference side are electrically connected to each other, an end portion of the first sub line portion on the outer circumference side and an end portion of the second sub line portion on the outer circumference side are electrically connected to each other, the plurality of dielectric layers further includes a fourth dielectric layer and a fifth dielectric layer, the fourth dielectric layer being provided at a location further toward another side of the stacking direction than the first dielectric layer, the fifth dielectric layer being provided at a location further toward the one side of the stacking direction than the second dielectric layer, the first lead conductor is provided on the fourth dielectric layer and electrically connects the first outer electrode and an end portion of the first main line portion on the inner circumference side, the second lead conductor is provided on the fifth dielectric layer and electrically connects the second outer electrode and an end portion of the second main line portion on the inner circumference side, the third lead conductor is provided on the fourth dielectric layer and electrically connects the third outer electrode and an end portion of the first sub line portion on the inner circumference side, and the fourth lead conductor is provided on the fifth dielectric layer and electrically connects the fourth outer electrode and an end portion of the second sub line portion on the inner circumference side.

9. The directional coupler according to claim 8, wherein the first lead conductor, the second lead conductor, the third lead conductor, and the fourth lead conductor are substantially linear in shape.

10. The directional coupler according to claim 9, wherein in the planar view along the stacking direction, the first lead conductor and the fourth lead conductor form two sides of a substantially isosceles triangle, the two sides being substantially equal in length, and in the planar view along the stacking direction, the second lead conductor and the third lead conductor form two sides of a substantially isosceles triangle, the two sides being substantially equal in length.

11. The directional coupler according to claim 3, wherein in the planar view along the stacking direction, the first main line portion, the second main line portion, the first sub line portion, and the second sub line portion are substantially spiral in shape.

12. The directional coupler according to claim 5, further comprising:

a first outer electrode, a second outer electrode, a third outer electrode, and a fourth outer electrode; and a first lead conductor, a second lead conductor, a third lead conductor, and a fourth lead conductor, wherein an end portion of the first main line portion on the outer circumference side and an end portion of the second main line portion on the outer circumference side are electrically connected to each other, an end portion of the first sub line portion on the outer circumference side and an end portion of the second sub line portion on the outer circumference side are electrically connected to each other, the plurality of dielectric layers further includes a fourth dielectric layer and a fifth dielectric layer, the fourth dielectric layer being provided at a location further toward another side of the stacking direction than the first dielectric layer, the fifth dielectric layer being provided at a location further toward the one side of the stacking direction than the second dielectric layer, the first lead conductor is provided on the fourth dielectric layer and electrically connects the first outer electrode and an end portion of the first main line portion on the inner circumference side, the second lead conductor is provided on the fifth dielectric layer and electrically connects the second outer electrode and an end portion of the second main line portion on the inner circumference side, the third lead conductor is provided on the fourth dielectric layer and electrically connects the third outer electrode and an end portion of the first sub line portion on the inner circumference side, and the fourth lead conductor is provided on the fifth dielectric layer and electrically connects the fourth outer electrode and an end portion of the second sub line portion on the inner circumference side.

13. The directional coupler according to claim 6, further comprising:

a first outer electrode, a second outer electrode, a third outer electrode, and a fourth outer electrode; and a first lead conductor, a second lead conductor, a third lead conductor, and a fourth lead conductor, wherein an end portion of the first main line portion on the outer circumference side and an end portion of the second main line portion on the outer circumference side are electrically connected to each other, an end portion of the first sub line portion on the outer circumference side and an end portion of the second sub line portion on the outer circumference side are electrically connected to each other, the plurality of dielectric layers further includes a fourth dielectric layer and a fifth dielectric layer, the fourth dielectric layer being provided at a location further toward another side of the stacking direction than the first dielectric layer, the fifth dielectric layer being provided at a location further toward the one side of the stacking direction than the second dielectric layer, the first lead conductor is provided on the fourth dielectric layer and electrically connects the first outer electrode and an end portion of the first main line portion on the inner circumference side, the second lead conductor is provided on the fifth dielectric layer and electrically connects the second outer electrode and an end portion of the second main line portion on the inner circumference side, the third lead conductor is provided on the fourth dielectric layer and electrically connects the third outer electrode and an end portion of the first sub line portion on the inner circumference side, and the fourth lead conductor is provided on the fifth dielectric layer and electrically connects the fourth outer electrode and an end portion of the second sub line portion on the inner circumference side.

14. The directional coupler according to claim 7, further comprising:

a first outer electrode, a second outer electrode, a third outer electrode, and a fourth outer electrode; and a first lead conductor, a second lead conductor, a third lead conductor, and a fourth lead conductor, wherein an end portion of the first main line portion on the outer circumference side and an end portion of the second main line portion on the outer circumference side are electrically connected to each other, an end portion of the first sub line portion on the outer circumference side and an end portion of the second sub line portion on the outer circumference side are electrically connected to each other, the plurality of dielectric layers further includes a fourth dielectric layer and a fifth dielectric layer, the fourth dielectric layer being provided at a location further toward another side of the stacking direction than the first dielectric layer, the fifth dielectric layer being provided at a location further toward the one side of the stacking direction than the second dielectric layer, the first lead conductor is provided on the fourth dielectric layer and electrically connects the first outer electrode and an end portion of the first main line portion on the inner circumference side, the second lead conductor is provided on the fifth dielectric layer and electrically connects the second outer electrode and an end portion of the second main line portion on the inner circumference side, the third lead conductor is provided on the fourth dielectric layer and electrically connects the third outer electrode and an end portion of the first sub line portion on the inner circumference side, and the fourth lead conductor is provided on the fifth dielectric layer and electrically connects the fourth outer electrode and an end portion of the second sub line portion on the inner circumference side.

* * * * *